US007880706B2

(12) United States Patent
Youn

(10) Patent No.: US 7,880,706 B2
(45) Date of Patent: Feb. 1, 2011

(54) DISPLAY DEVICE, METHOD OF DRIVING THE SAME AND DISPLAY DEVICE DRIVING APPARATUS

(75) Inventor: Won-Bong Youn, Hwaseong-si (KR)

(73) Assignee: Samsung Electronics Co., Ltd. (KR)

( * ) Notice: Subject to any disclaimer, the term of this patent is extended or adjusted under 35 U.S.C. 154(b) by 1032 days.

(21) Appl. No.: 11/498,936

(22) Filed: Aug. 3, 2006

(65) Prior Publication Data

US 2007/0030224 A1 Feb. 8, 2007

(30) Foreign Application Priority Data

Aug. 3, 2005 (KR) ..... 10-2005-0070989

(51) Int. Cl.
*G09G 3/36* (2006.01)

(52) U.S. Cl. ..... 345/89; 345/211

(58) Field of Classification Search ..... 345/89
See application file for complete search history.

(56) References Cited

U.S. PATENT DOCUMENTS 5,198,897 A * 3/1993 Baldwin ..... 348/104
6,559,822 B2 * 5/2003 Okuzono ..... 345/96
2003/0085859 A1 * 5/2003 Lee ..... 345/87
2003/0189537 A1 * 10/2003 Yun ..... 345/87
2007/0262972 A1 * 11/2007 Nakata ..... 345/204

* cited by examiner

*Primary Examiner*—Alexander Eisen
*Assistant Examiner*—Andrew Schnirel
(74) *Attorney, Agent, or Firm*—Cantor Colburn LLP

(57) ABSTRACT

A display device includes a display panel, a reference gamma processing part, a source driving part, and a timing controlling part. The display panel includes a plurality of pixel parts displaying an image. The reference gamma processing part outputs a reference gamma voltage in every period. The source driving part converts a data signal into a data voltage of an analog type based on the reference gamma voltage during the period. The timing controlling part delays the data signal of at least one frame and the reference gamma voltage based on the at least one frame corresponding to the data signal to apply a delayed data signal and a delayed reference gamma voltage to the source driving part. Therefore, an image display quality is improved.

21 Claims, 11 Drawing Sheets

2x1 INVERSION METHOD

DISPLAY DEVICE, METHOD OF DRIVING THE SAME AND DISPLAY DEVICE DRIVING APPARATUS

The present application claims priority to Korean Patent Application No. 2005-70989, filed on Aug. 3, 2005 and all the benefits accruing therefrom under 35 U.S.C. §119, and the contents of which in its entirety are herein incorporated by reference.

BACKGROUND OF THE INVENTION

1. Field of the Invention

The present invention relates to a display device, a method of driving the display device, and an apparatus for driving the display device. More particularly, the present invention relates to a display device capable of improving an image display quality, a method of driving the display device, and an apparatus for driving the display device.

2. Description of the Related Art

A liquid crystal display ("LCD") device includes an LCD panel and a driving module that applies driving signals to the LCD panel. The LCD panel includes a plurality of gate lines, a plurality of source lines, also known as data lines, and a plurality of pixel parts that are defined by the gate and source lines adjacent to each other. A switching element, a liquid crystal capacitor, and a storage capacitor are formed in each of the pixel parts.

When a driving voltage is constantly applied to liquid crystals of the LCD device, characteristics of the liquid crystals are deteriorated. In order to improve the characteristics of the liquid crystals, the liquid crystals are driven through an inversion method. In the inversion method, a level of the driving voltage is inverted at a predetermined interval with respect to a predetermined reference voltage.

The inversion method includes a frame inversion method, a line inversion method, a dot inversion method, etc. In the frame inversion method, the liquid crystals are inverted in every frame. In the line inversion method, the liquid crystals are inverted in each of the lines. In the dot inversion method, the liquid crystals are inverted in each of the dots.

When a middle gray-scale image or a dot patterned image is displayed on the LCD device, various flickers are displayed on the LCD device. In the frame inversion method, the flicker is displayed on an entire display panel of the LCD device. In the line inversion method, the flicker is displayed along a horizontal line or a vertical line of the LCD device. In the dot inversion method, the flicker is displayed on each of the dots.

In order to minimize the flicker, the LCD device is driven through a 2×1 inversion method.

FIG. 1 is a plan view showing a 2×1 inversion method. Referring to FIG. 1, a data voltage of a present frame 2N FRAME is inverted with respect to a data voltage of a previous frame 2N−1 FRAME. The inversion is performed in every 2H period.

In the 2×1 inversion method, the voltage of the data signal is changed by the 2H period so that a ripple of a driving voltage AVDD is generated at every 2H period. A horizontal stripe line is displayed on the LCD device by the ripple of the driving voltage AVDD.

BRIEF SUMMARY OF THE INVENTION

The present invention provides a display device capable of improving an image display quality.

The present invention also provides a method of driving the above-mentioned display device.

The present invention also provides an apparatus for driving the display device.

A display device in accordance with exemplary embodiments of the present invention includes a display panel, a reference gamma processing part, a source driving part, and a timing controlling part. The display panel includes a plurality of pixel parts displaying an image. The reference gamma processing part outputs a reference gamma voltage in every period. The source driving part converts a data signal into a data voltage of an analog type based on the reference gamma voltage during the period. The timing controlling part delays the data signal of at least one frame and the reference gamma voltage based on the at least one frame corresponding to the data signal delayed by the timing controlling part to apply a delayed data signal and a delayed reference gamma voltage to the source driving part.

A method of driving a display device in accordance with exemplary embodiments of the present invention is provided as follows. The display device includes a display panel having a plurality of pixel parts displaying an image. At least one frame corresponding to a data signal is determined. The data signal of the at least one frame and a reference gamma voltage are delayed based on the at least one frame corresponding to the data signal to output a delayed data signal of the at least one frame and a delayed reference gamma voltage. The data signal is converted into a data voltage of an analog type based on the reference gamma voltage. A polarity of the data voltage is inverted in every 2H period to apply the inverted data voltage to the pixel parts, wherein H is a horizontal period.

A display device driving apparatus in accordance with exemplary embodiments of the present invention includes a reference gamma processing part, a source driving part, and a timing controlling part. The display device includes a display panel having a plurality of pixel parts for displaying an image. The reference gamma processing part outputs a reference gamma voltage in every period. The source driving part converts a data signal into a data voltage of an analog type based on the reference gamma voltage during the period. The timing controlling part delays the data signal of at least one frame and the reference gamma voltage based on the at least one frame corresponding to the data signal to apply a delayed data signal and a delayed reference gamma voltage to the source driving part.

According to the present invention, the odd numbered frame, for example, is delayed by the 1H period, and the even numbered frame is displayed so that the horizontal stripe of the odd numbered frame is compensated by the horizontal stripe of the even numbered frame, thereby improving the image display quality.

BRIEF DESCRIPTION OF THE DRAWINGS

The above and other advantages of the present invention will become more apparent by describing in detail exemplary embodiments thereof with reference to the accompanying drawings, in which.

DETAILED DESCRIPTION OF THE INVENTION

Figure 1:
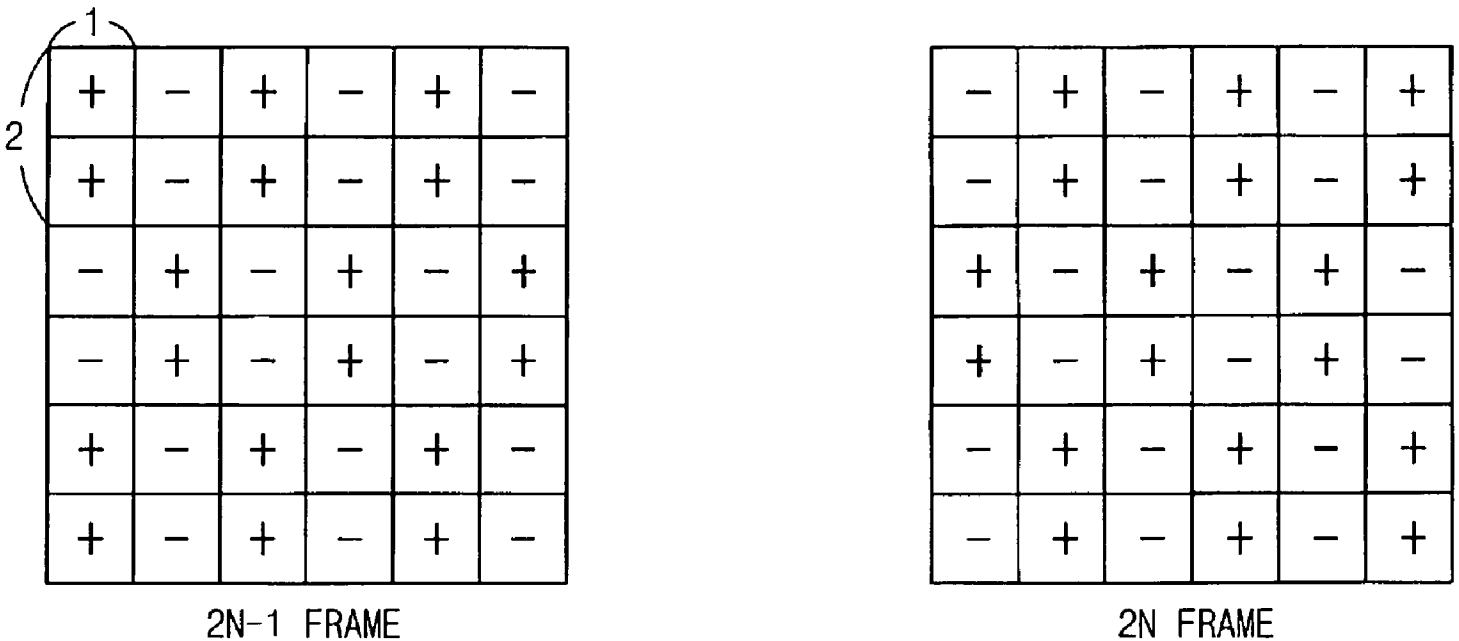
FIG. 1 (PRIOR ART)
FIG. 1 is a plan view showing a 2×1 inversion method.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the invention are described herein with reference to cross-section illustrations that are schematic illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the present invention will be described in detail with reference to the accompanying drawings.

Figure 2:
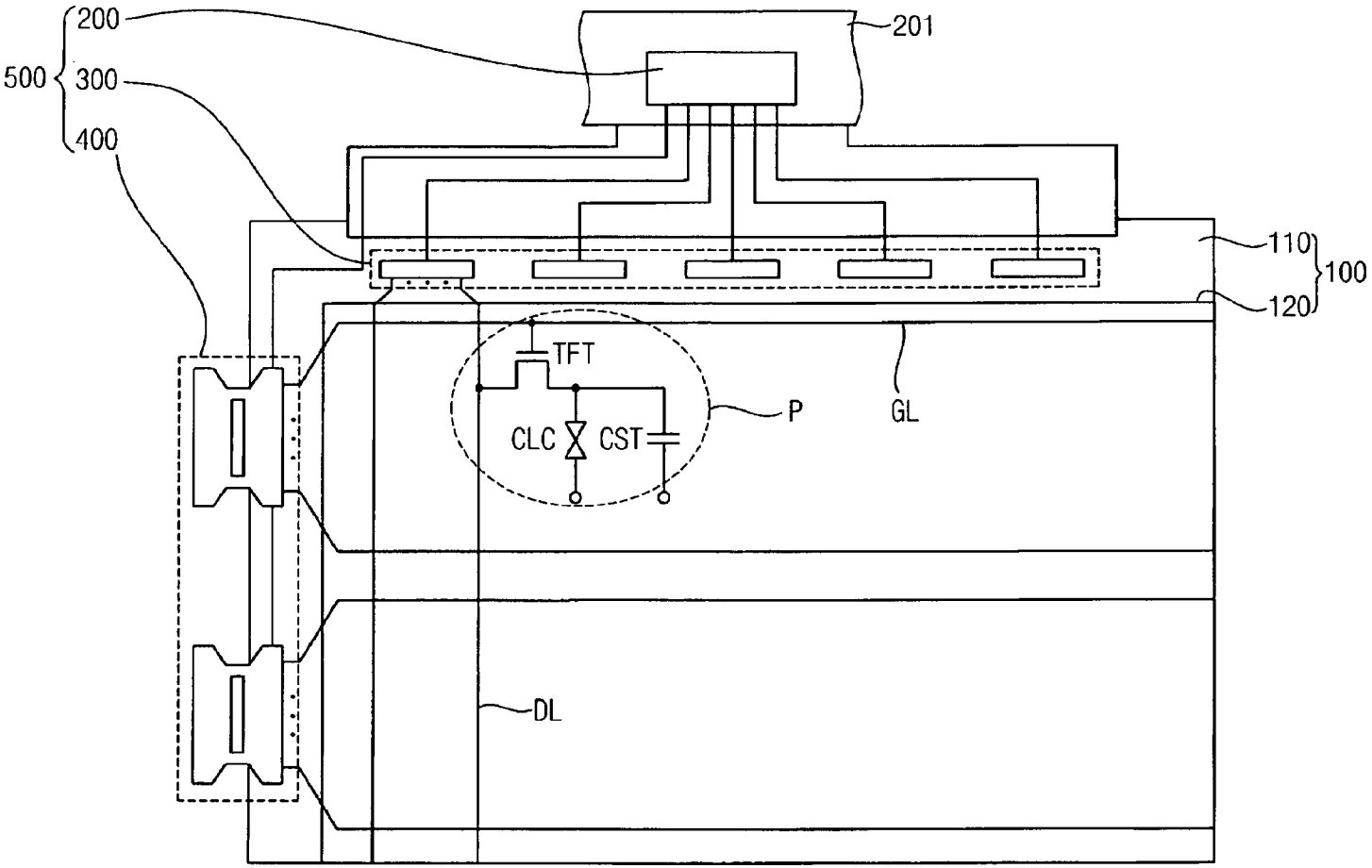
FIG. 2 is a plan view showing an exemplary display device in accordance with an exemplary embodiment of the present invention.

FIG. 2 is a plan view showing an exemplary display device in accordance with an exemplary embodiment of the present invention.

Referring to FIG. 2, the display device includes a display panel 100 and a driving module 500.

The display panel 100 includes a lower substrate 110, an upper substrate 120, and a liquid crystal layer (not shown). The liquid crystal layer (not shown) is interposed between the lower and upper substrates 110 and 120. The display panel 100 is divided into a display region and a peripheral region. The peripheral region surrounds the display region.

A plurality of source lines DL and a plurality of gate lines GL are in the display region. The gate lines GL cross the source lines DL. Pixels P are defined by the source and gate lines DL and GL. A switching element TFT, such as a thin film transistor, a liquid crystal capacitor CLC, and a storage capacitor CST are in each pixel P. The liquid crystal capacitor CLC is electrically connected to the switching element TFT.

The driving module 500 includes a main driving unit 200, a source driving unit 300, and a gate driving unit 400.

The main driving unit 200 is mounted on a source printed circuit board ("PCB") 201 to generate driving signals for driving the display panel 100.

The source driving unit 300 may be in the peripheral region of the display panel 100. The source driving unit 300 includes a plurality of source driving chips, as will be further described below. Each of the source driving chips applies data signals to a portion of the source lines DL.

The gate driving unit 400 may also be in the peripheral region of the display panel 100. The gate driving unit 400 includes a plurality of gate driving chips. Each of the gate driving chips applies gate signals to a portion of the gate lines GL.

Figure 3:
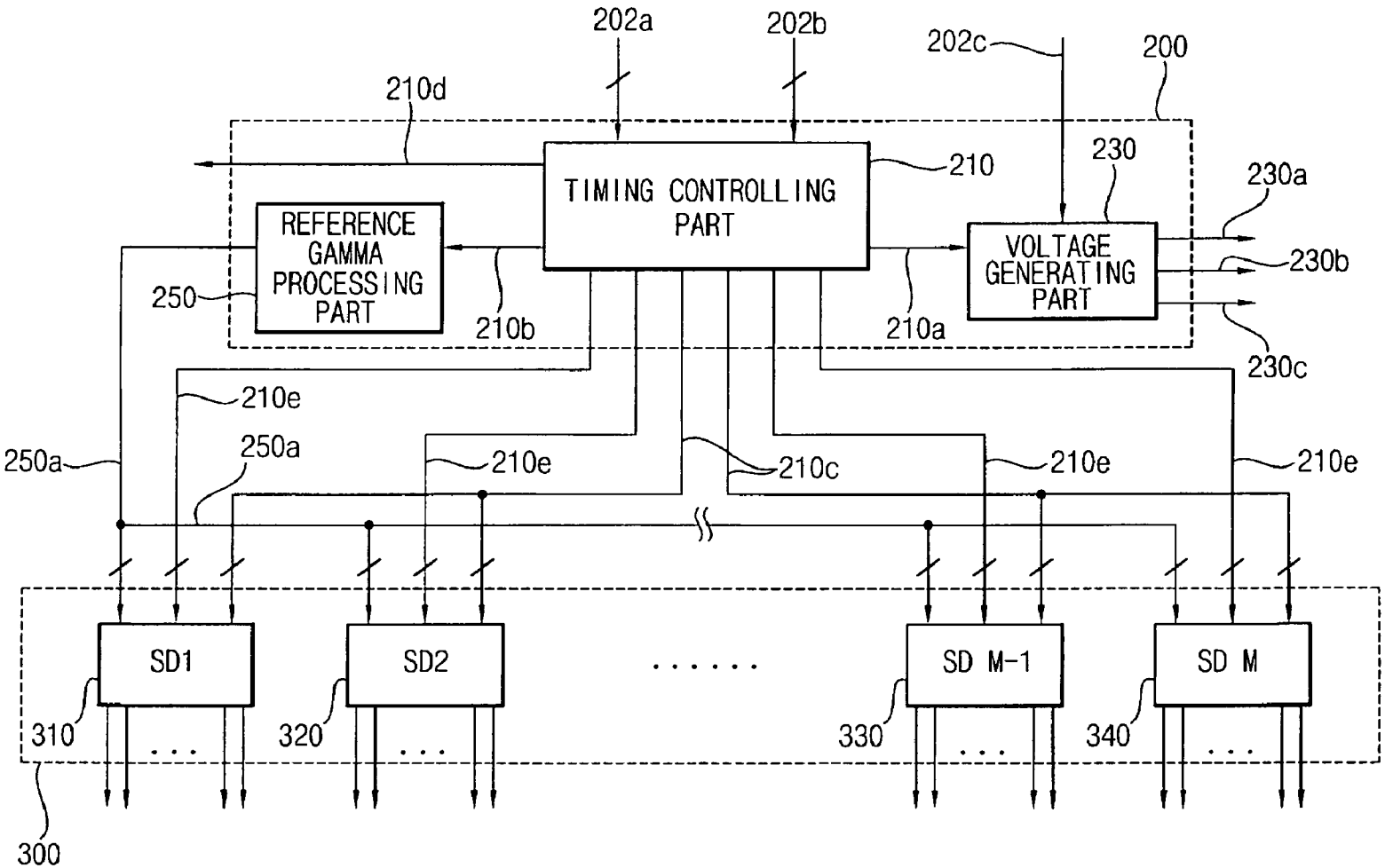
FIG. 3 is a block diagram showing an exemplary main driving unit shown in FIG. 2.

FIG. 3 is a block diagram showing an exemplary main driving unit shown in FIG. 2.

Referring to FIGS. 2 and 3, the main driving unit 200 includes a timing controlling part 210, a voltage generating part 230, and a reference gamma processing part 250.

The timing controlling part 210 generates a first control signal 210*a* for controlling the voltage generating part 230, a second control signal 210*b* for controlling the reference gamma processing part 250, a third control signal 210*c* for controlling the source driving unit 300, and a fourth control signal 210*d* for controlling the gate driving unit 400 based on a control signal 202*a* from an externally provided apparatus.

The timing controlling part 210 processes a data signal 202*b* by a unit frame to apply a processed data signal 210*e* to the source driving unit 300. In particular, the timing controlling part 210 counts the number of vertical synchronizing signals VSYNC of the control signal 202*a* to determine the data signal 202*b* as an odd numbered frame or an even numbered frame.

When the data signal 202*b* corresponds to the odd numbered frame, the timing controlling part 210 applies the data signal 210*e* to the source driving chips 310, 320, 330 and 340 of the source driving unit 300. When the data signal 202*b* corresponds to the even numbered frame, the timing controlling part 210 delays the data signal 210*e* for a 1H period, and then applies the data signal 210*e* to the source driving chips 310, 320, 330 and 340.

The voltage generating part 230 generates the driving voltages for driving the display device based on an electric power voltage 202*c* that is provided from an exterior to the voltage generating part 230. In particular, the driving voltages includes an analog driving voltage AVDD 230*a* for driving the source driving unit 300, gate driving voltages VON and VOFF 230*b* for driving the gate driving unit 400, and common voltages VCOM and VST 230*c* for driving the liquid crystal capacitor CLC and the storage capacitor CST.

The reference gamma processing part 250 generates reference gamma voltages 250*a* in every period based on the second control signal 210*b*. By example only, the reference gamma processing part 250 may generate the reference gamma voltages 250*a* in every 17H period. That is, the reference gamma processing part 250 may repetitively output the reference gamma voltages 250*a* in every 17H period. While a 17H period is described herein for exemplary purposes, it should be understood that alternate periods would also be within the scope of these embodiments. The reference gamma processing part 250 reads stored reference gamma data based on the second control signal 210*b* to convert the reference gamma data into analog typed reference gamma voltages 250*a*.

The reference gamma voltages 250*a* are applied to the source driving chips 310, 320, 330 and 340 in serial through one line. When the reference gamma voltages 250*a* are transmitted in serial, the number of the lines in the peripheral region of the display panel 100 is decreased.

Figure 4:
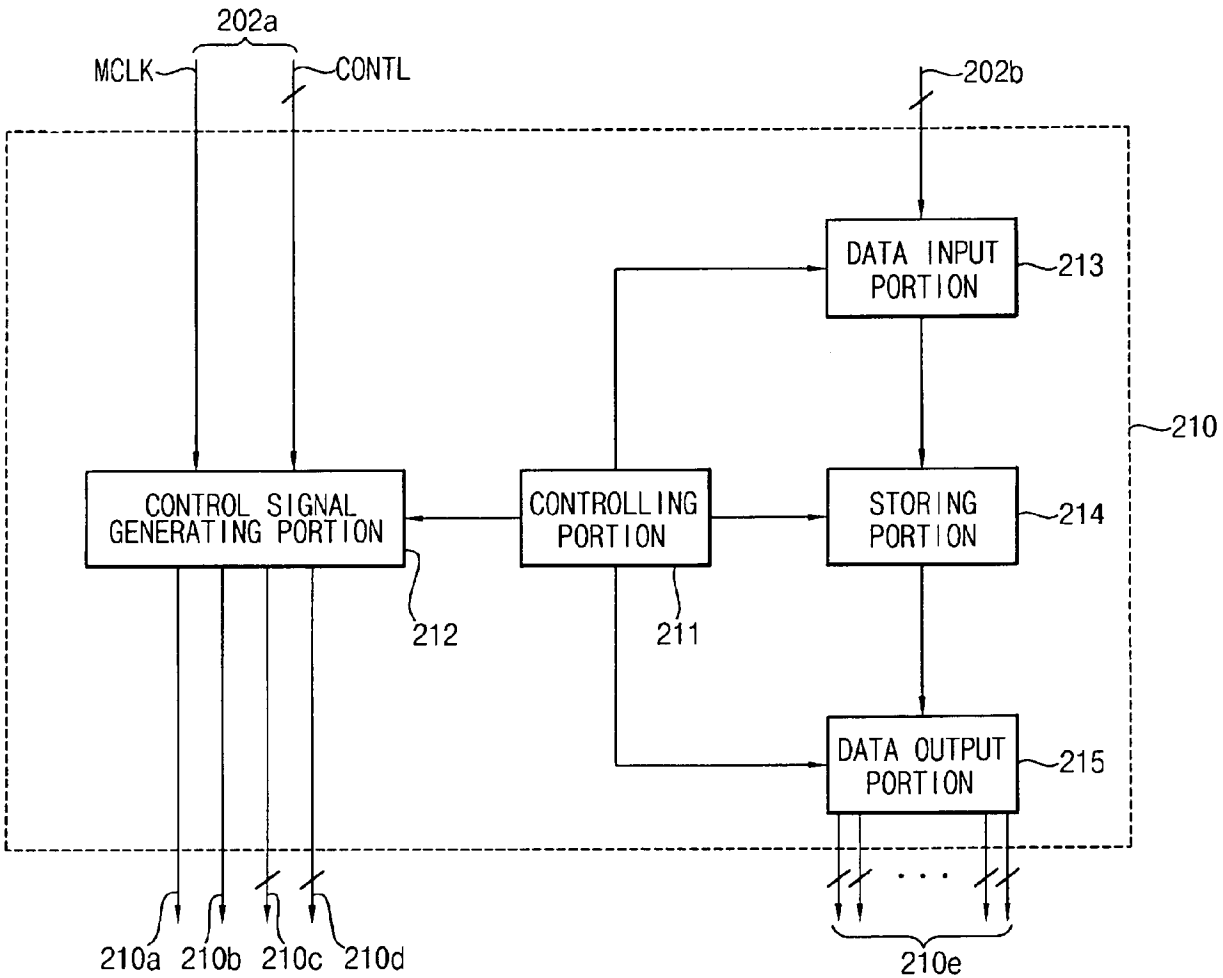
FIG. 4 is a block diagram showing an exemplary timing controlling part shown in FIG. 3.

FIG. 4 is a block diagram showing an exemplary timing controlling part shown in FIG. 3.

Referring to FIGS. 3 and 4, the timing controlling part 210 includes a controlling part 211, a control signal generating part 212, a data input part 213, a storing part 214, and a data output part 215.

The controlling part 211 controls the timing controlling part 210. The controlling part 211 counts the number of vertical synchronizing signals VSYNC of a primary controlling signal CONTL of the control signal 202*a* to determine the data signal as an odd numbered frame data or an even numbered frame data. Therefore, the controlling part 211 controls the data output part 215.

The control signal generating part 212 generates the first, second, third, and fourth control signals 210*a*, 210*b*, 210*c* and 210*d* based on a primary clock signal MCLK and a primary control signal CONTL of the control signal 202*a*. The primary control signal CONTL includes a horizontal synchronizing signal HSYNC, a vertical synchronizing signal VSYNC, and a data enable signal DE.

The first control signal 210*a* controls the voltage generating part 230. The second control signal 210*b* controls the reference gamma processing part 250 in every period so that the reference gamma processing part 250 applies refreshed reference gamma voltages 250*a* to the source driving unit 300. For example, the second control signal 210*b* may control the reference gamma processing part 250 in every 17H period.

The third control signal 210*c* includes a horizontal start signal STH, a load signal TP, and an inversion signal REV. The inversion signal REV is a control signal of a 2×1 inversion method. The fourth control signal 210*d* includes a vertical start signal STV, a first clock signal CK, and a second clock signal CKB.

The data input part 213 receives the data signal 202*b* from the externally provided apparatus in a first interface method. For example, the first interface method is a low voltage differential signal ("LVDS") method. The data signal 202*b* includes red, green and blue data signals.

The storing part 214 stores the data signal from the data input part 213 by a predetermined unit. For example, the storing part 214 stores the data signal by a unit frame.

The data output part 215 applies the data signal 210*e* that is read from the storing part 214 based on the control signal of the controlling part 211 to each of the source driving chips 310, 320, 330, 340 of the source driving unit 300. The data output part 215 applies the data signal 210*e* in a point-to-point method.

When the data signal applied to the controlling part 211 corresponds to the odd numbered frame, the read data signal that is read from the storing part 214 is applied to the source driving unit 300. When the data signal applied to the controlling part 211 corresponds to the even numbered frame, the read data signal that is read from the storing part 214 is delayed by 1H period, and then applied to the source driving unit 300. In addition, the controlling part 211 drives the reference gamma processing part 250 after the 1H period.

Therefore, after the data signal 210*e* of the odd numbered frame is applied to the source driving unit 300, the data signal 210*e* of the even numbered frame is applied to the source driving unit 300.

Figure 5:
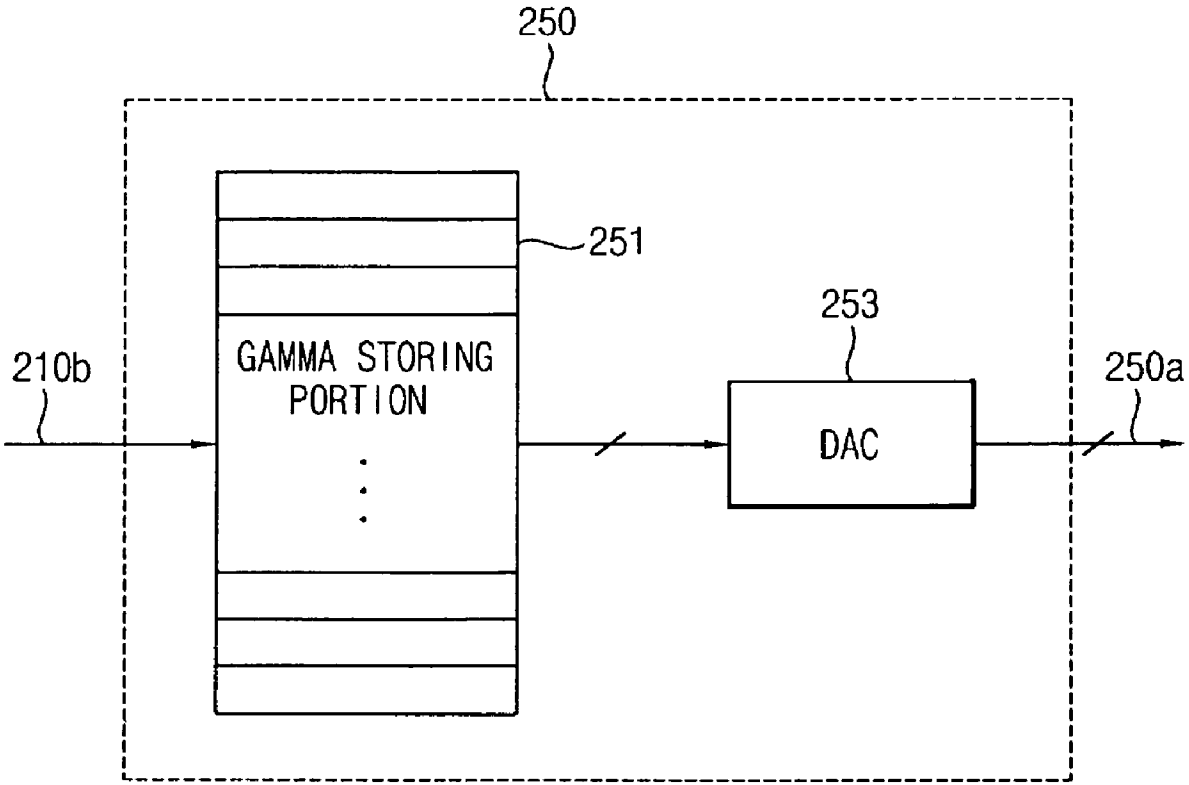
FIG. 5 is a block diagram showing an exemplary reference gamma processing part shown in FIG. 3.

FIG. 5 is a block diagram showing an exemplary reference gamma processing part shown in FIG. 3.

Referring to FIGS. 3 and 5, the reference gamma processing part 250 includes a gamma storing part 251 and a digital-analog converter ("DAC") 253. Reference gamma data are stored in the gamma storing part 251. The reference gamma data correspond to predetermined number of gray-scales that are sampled from all gray-scales.

Red reference gamma data corresponding to a red color, green reference gamma data corresponding to a green color and blue reference gamma data corresponding to a blue color may be stored in the gamma storing part 251.

The reference gamma data stored in the gamma storing part 251 may be read in every period based on the second control signal 210*b* of the timing controlling part 210. The reference gamma data may be read in every 17H period.

The DAC 253 converts the read reference gamma data that are from the gamma storing part 251 into reference gamma voltages 250*a* of an analog type to apply the analog typed reference gamma voltages 250*a* to the source driving chips 310, 320, 330, 340 of the source driving unit 300, in serial. That is, the reference gamma voltages 250*a* are applied to the source driving chips 310, 320, 330, 340 in a serial gamma voltage method.

Figure 6:
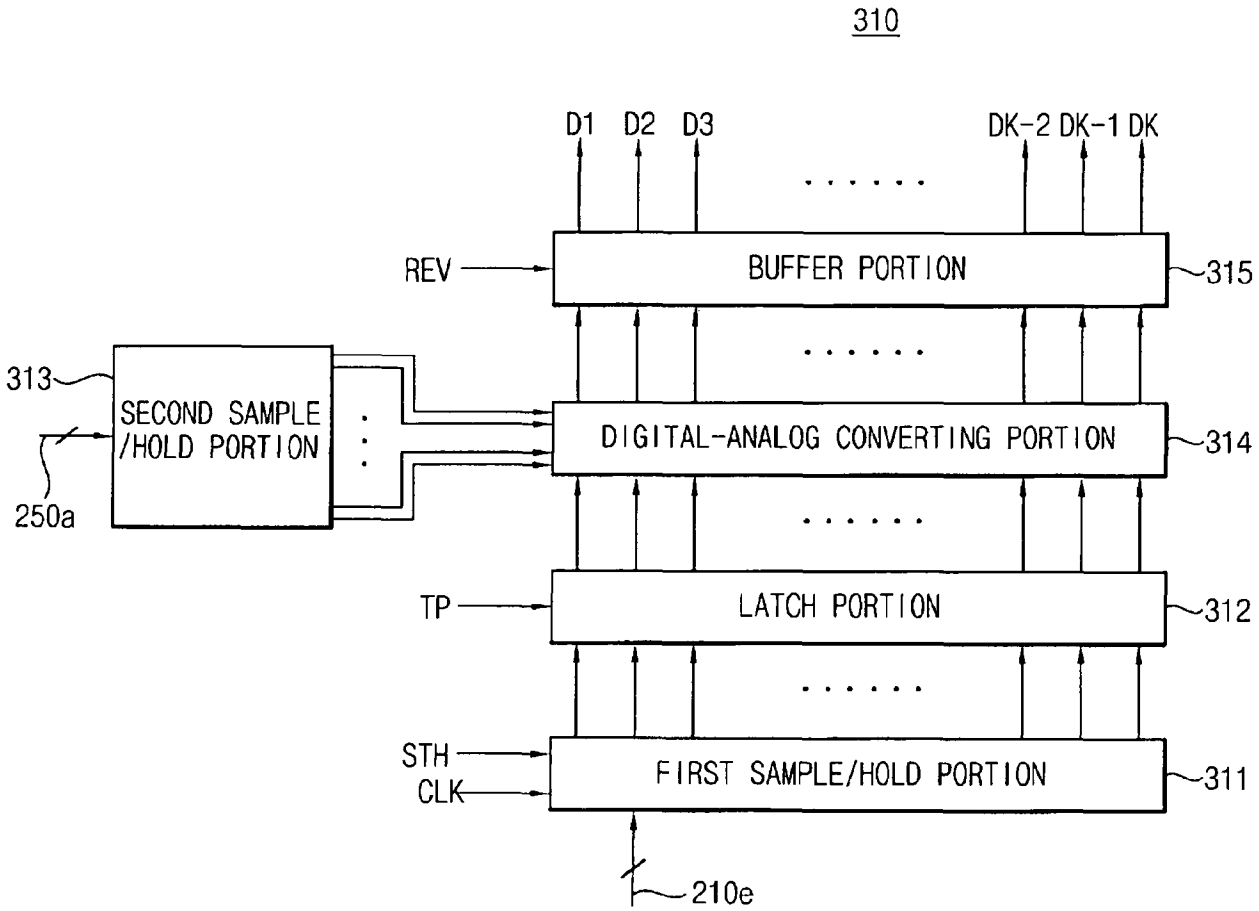
FIG. 6 is a block diagram showing an exemplary source driving chip shown in FIG. 3.

FIG. 6 is a block diagram showing an exemplary source driving chip shown in FIG. 3. While a source driving chip 310 is shown in FIG. 6, it should be understood that the other source driving chips in the source driving unit 300 may be similarly formed.

Referring to FIGS. 3 and 6, the source driving chip 310 includes a first sample/hold part 311, a latch part 312, a second sample/hold part 313, a digital-analog converting part 314, and a buffer part 315.

The first sample/hold part 311 holds a predetermined number of the data signals 210*e* that are sampled by the first sample/hold part 311 from the data signals 210*e* of the timing controlling part 210 based on the horizontal start signal STH from the third control signal 210*c*. The data signals 210*e* sampled by the first sample/hold part 311 are applied to the latch part 312 based on the control signal CLK.

The latch part 312 latches the data signals outputted from the first sample/hold part 311. When the load signal TP from the third control signal 210*c* is applied to the latch part 312, the latched data signals are applied to the digital-analog converting part 314.

When the reference gamma voltages 250*a* from the reference gamma processing part 250 are applied to the second sample/hold part 313 in serial, the second sample/hold part 313 holds a portion of the reference gamma voltages 250*a* that are sampled by the second sample/hold part 313. The sampled reference gamma voltages may be applied to the second sample/hold part 313 in every 17H period, for example, based on the control signal of the timing controlling part 210.

The second sample/hold part 313 applies the held reference gamma voltages to the digital-analog converting part 314. The held reference gamma voltages may be applied to the digital-analog converting part 314 in, for example, every 17H period.

The digital-analog converting part 314 converts the data signals from the latch portion 312 into the data voltage of the analog type based on the reference gamma voltages that are from the second sample/hold part 313. The digital-analog converting part 314 applies the analog typed data voltage to the buffer part 315.

The buffer part 315 inverts a level of the analog typed data voltage based on the inversion signal REV of the third control signal 210*c*. In the 2×1 inversion method, the inversion signal REV inverts the data voltage in every 2H period.

The data voltages D1, D2, D3, . . . , DK−2, DK−1, DK outputted from the buffer part 315 are applied to the source lines DL of the display panel 100.

Figure 7:
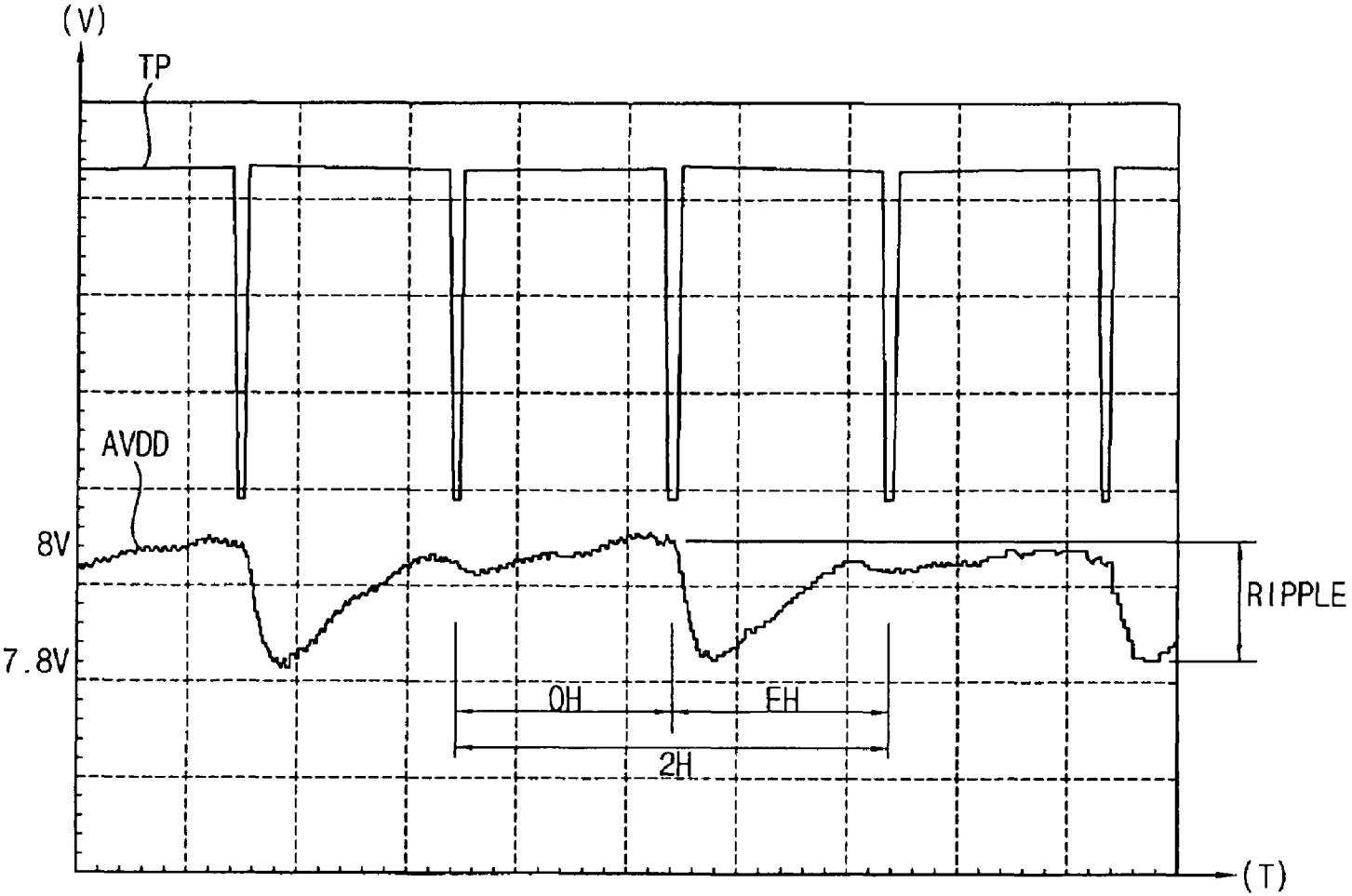
FIG. 7 is a timing diagram showing an input signal applied to the exemplary source driving chip shown in FIG. 3.

FIG. 7 is a timing diagram showing an input signal applied to the exemplary source driving chip shown in FIG. 6.

Referring to FIGS. 6 and 7, the load signal TP of the third control signal 210*c* and the analog driving voltage AVDD 230*a* from the voltage generating part 230 are applied to the source driving chip 310.

The load signal TP is applied to the source driving chip 310 in the 1H period so that the data signal that is latched by the latch part 312 is applied to the digital-analog converting part 314. The load signal TP controls the latch part 312 so that the data voltages are loaded to the source lines DL of the display panel 100.

The analog driving voltage AVDD 230*a* from the voltage generating part 230 is applied to the source driving chip 310.

In the 2×1 inversion method, the source driving chip 310 generates the data voltage inverted in the 2H period so that a ripple is generated in the analog typed driving voltage AVDD 230*a*.

In particular, during an odd-numbered horizontal time interval ("OH"), the source driving chip 310 is driven by an analog driving voltage AVDD of a normal level, for example, about 8 volts. In contrast, during an even-numbered horizontal time interval ("EH"), the source driving chip 310 is driven by an analog driving voltage AVDD that is lower than a normal level, for example, about 7.8 volts.

When the reference gamma voltages 250*a*, which are continuously inputted from the second sample/hold part 313, are held during the even-numbered horizontal time interval EH, a ripple of the analog driving voltage AVDD 230*a* is reflected in the reference gamma voltages 250*a*.

The data voltage that is from the digital-analog converting part 314 is generated based on the reference gamma voltages 250*a* that have the ripples so that the data voltage also has the error. Therefore, first reference gamma voltages that are held during an odd numbered horizontal period OH have different gray scales as compared to second reference gamma voltages that are held during an even numbered horizontal period EH.

The voltage difference corresponding to the holding period of the reference gamma voltages 250*a* may be generated in the display device of the 2×1 inversion method and the serial gamma voltage method to generate bright and dark horizontal stripes on the display device.

Hereinafter, in FIGS. 8 through 10B, the stripes, generated in the display device of the 2×1 inversion method, are removed to improve the image display quality of the display device.

Figure 8:
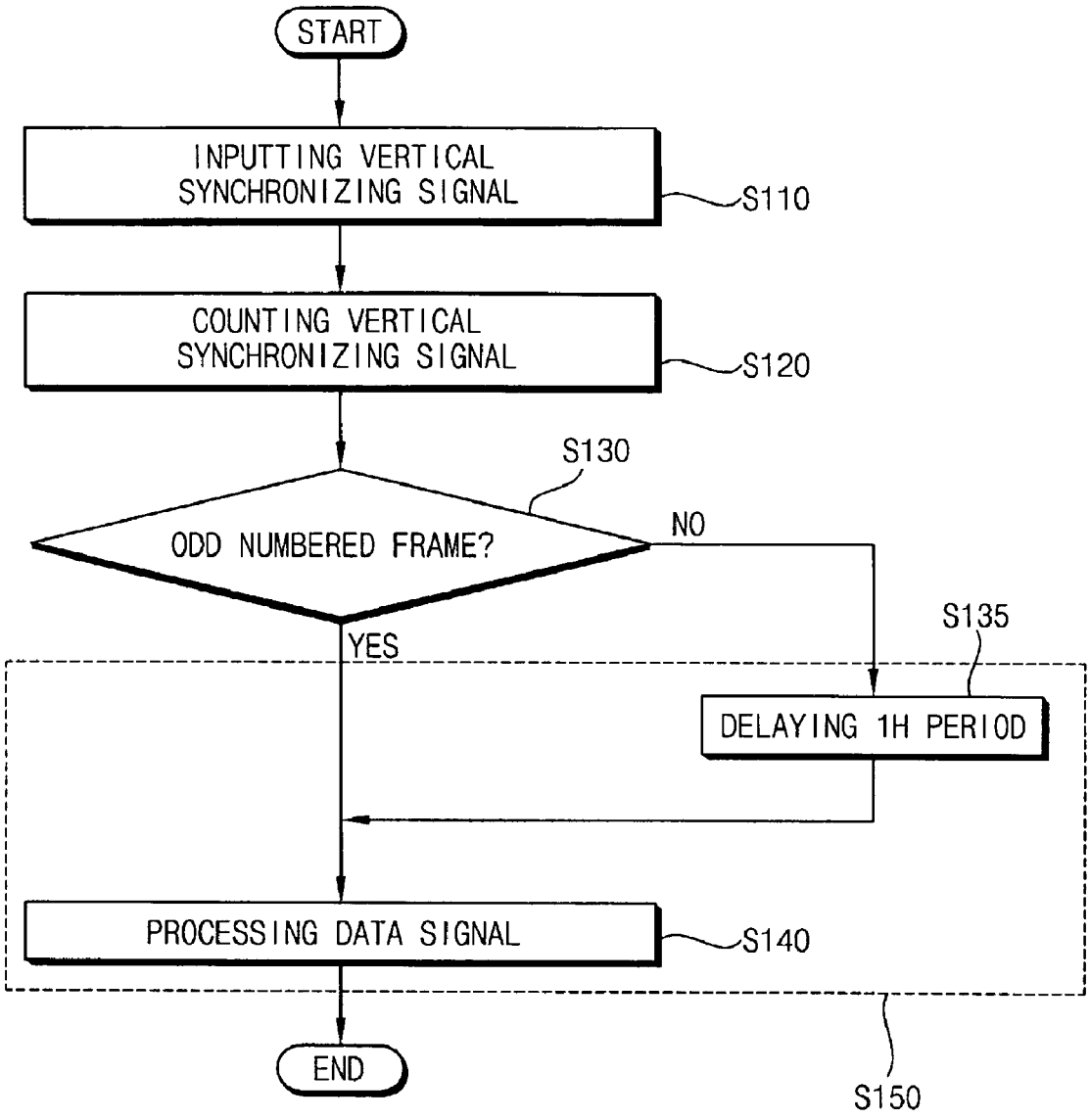
FIG. 8 is a flow chart showing an exemplary method of driving the exemplary main driving unit shown in FIG. 3.
Figure 9:
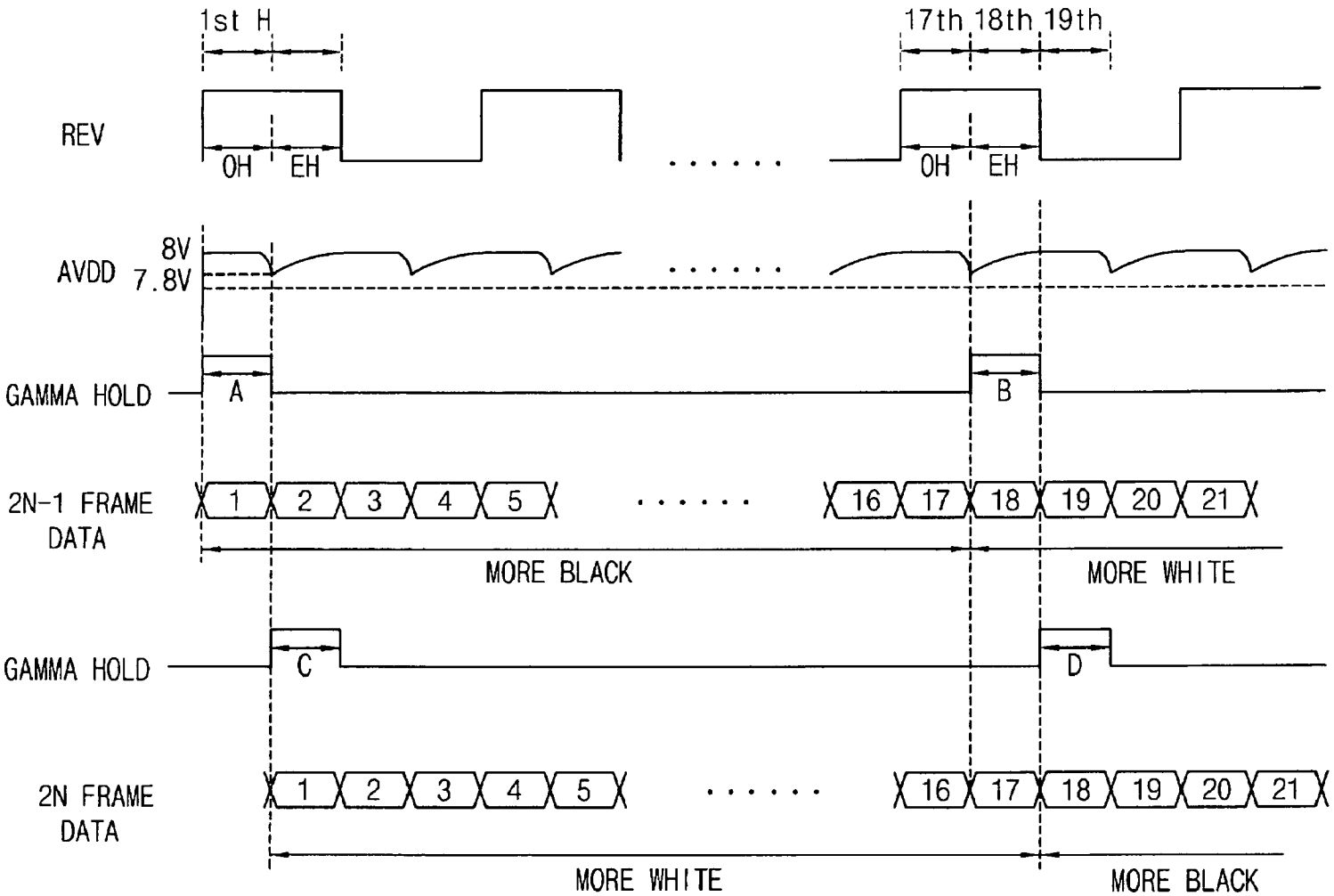
FIG. 9 is a timing diagram showing input/output signals of the exemplary main driving unit shown in FIG. 3.
Figure 10A:
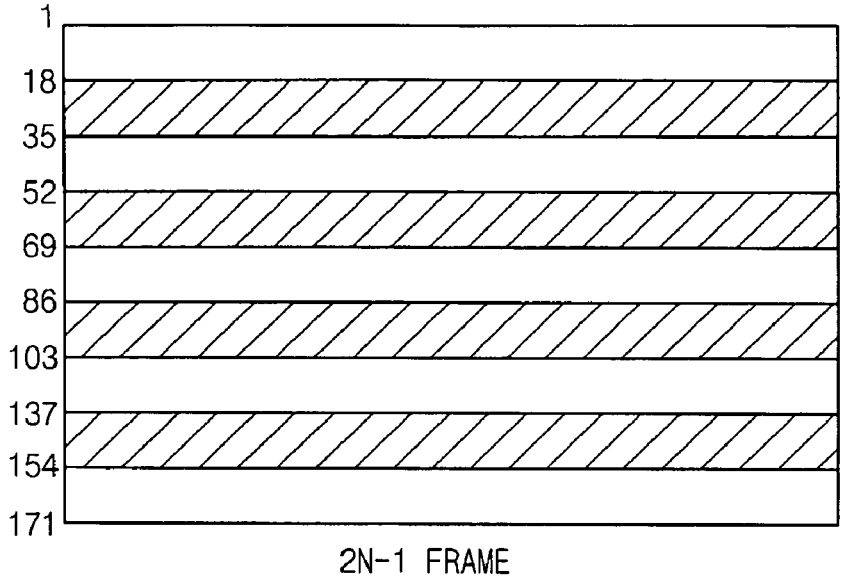
FIGS. 10A and 10B are plan views showing adjacent frames displayed by the exemplary method shown in FIG. 8.
Figure 10B:
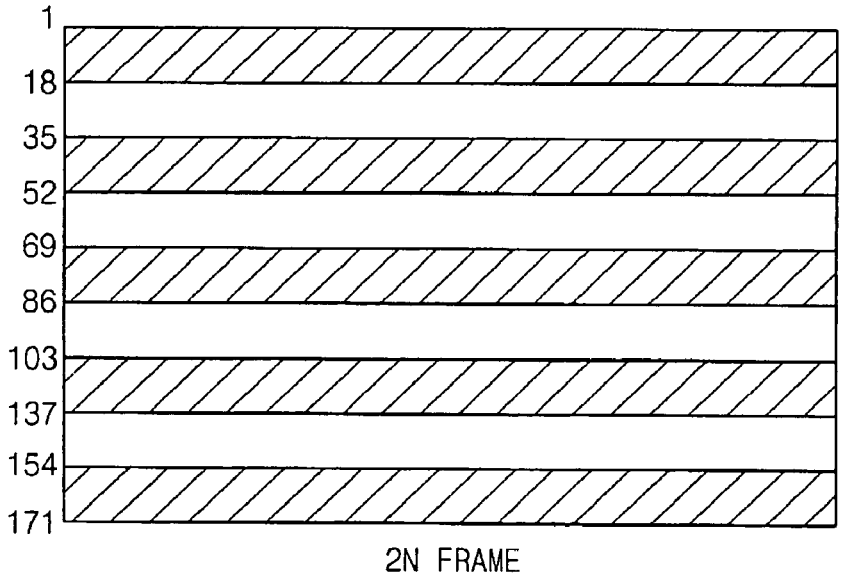

FIG. 8 is a flow chart showing an exemplary method of driving the exemplary main driving unit shown in FIG. 3. FIG. 9 is a timing diagram showing input/output signals of the exemplary main driving unit shown in FIG. 3. FIGS. 10A and 10B are plan views showing adjacent frames displayed by the exemplary method shown in FIG. 8.

Referring to FIGS. 3 to 9, the voltage generating part 230 applies the analog typed driving voltage AVDD 230*a* to the source driving chips 310, 320, 330 and 340 of the source driving unit 300.

The source driving chips 310, 320, 330 and 340 convert the data signals 210*e* of a digital type into the analog typed data voltages D1 to DK based on the analog typed driving voltage AVDD 230*a*. In the 2×1 inversion driving method, the analog typed driving voltage AVDD 230*a* that is applied to the source driving chips 310, 320, 330 and 340 has the voltage difference generated in every 2H period.

The analog typed driving voltage AVDD of the odd numbered horizontal period OH is different from the analog typed driving voltage AVDD of the even numbered horizontal period EH. That is, the odd numbered horizontal period OH has a normal level (for example, about 8V), and the even numbered horizontal period EH has a low level (for example, about 7.8V).

The control signal 202*a* and the data signal 202*b* are applied to the timing controlling part 210, and the control signal 202*a* includes vertical synchronization signals, as indicated in block S110. The timing controlling part 210 processes the data signal 202*b* applied to the timing controlling part 210 based on the control signal 202*a* from the externally provided apparatus.

As indicated in block S120, the timing controlling part 210 counts the vertical synchronizing signals VSYNC of the control signal 202*a* to determine the frame corresponding to the data signal 202*b*.

For example, when the data signal 202*b* corresponds to the odd numbered frame 2N−1 FRAME, as indicated by block S130, the timing controlling part 210 controls the source driving unit 300 in a normal process, as indicated by block S140. Hereinafter, the normal process of controlling the source diving unit 300 is described.

The timing controlling part 210 applies the data signals 210*e* to the source driving chips 310, 320, 330 and 340, respectively. In addition, the timing controlling part 210 controls the reference gamma processing part 250 so that the refreshed reference gamma voltages 250*a* are applied to the source driving chips 310, 320, 330 and 340 in every predetermined period (for example, the 17H period).

The source driving chip 310 processes the data signals 1, 2, . . . 17 corresponding to the first to seventeenth lines based on the first reference gamma voltages 250*a* that are held by the second sample/hold part 313 during a first horizontal period A.

The source driving chip 310 processes the data signals 18, 19, . . . 34 corresponding to the eighteenth to thirty fourth lines based on the second reference gamma voltages 250*a* that are held by the second sample/hold part 313 during an eighteenth horizontal period B. The first reference gamma voltages 250*a* correspond to the analog typed driving voltage AVDD 230*a* of about 8V. The second reference gamma voltages 250*a* correspond to the analog typed driving voltage AVDD 230*a* of about 7.8V.

The timing controlling part 210 drives the display device so that the odd numbered frame 2N−1 FRAME shown in FIG. 10A is displayed on the display panel 100.

Referring to FIG. 10A, the dark gray scale (or the bright gray scale) is displayed on the display panel 100 of the display device corresponding to the first to seventeenth lines that are processed by the first reference gamma voltages 250*a*. The bright gray scale (or the dark gray scale) is displayed on the display panel 100 of the display device corresponding to the eighteenth to thirty fourth lines that are processed by the second reference gamma voltages 250*a*.

When the data signal 202*b* corresponds to the even numbered frame 2N FRAME, the timing controlling part 210 drives the source driving unit 300 through the 1H delay driving method, as indicated by block S135. Hereinafter, the 1H delay driving method is described.

The timing controlling part 210 delays the data signal 202*b* by the 1H period and applies the data signals 210*e* to the source driving chips 310, 320, 330 and 340, respectively, as again indicated by block S140. In addition, the timing controlling part 210 delays the reference gamma processing part 250 by the 1H period, as also indicated by block S135, and controls the reference gamma processing part 250 so that the refreshed reference gamma voltages 250*a* are applied to the source driving chips 310, 320, 330 and 340 in every predetermined period (for example, the 17H period), as indicated by block S140. Block 150 of FIG. 8 thus represents both the normal process when the data signal corresponds to the odd numbered frame, and the delay driving method when the data signal corresponds to the even numbered frame.

The first reference gamma voltages 250*a* are applied to the source driving chips 310, 320, 330 and 340 during 2H period that is delayed by the 1H period, and the refreshed second reference gamma voltages 250*a* are applied to the source driving chips 310, 320, 330 and 340 during 19H period that is delayed by the 1H period.

The source driving chip 310 processes the data signals 1', 2', . . . 17' corresponding to the first to seventeenth lines based on the first reference gamma voltages 250*a* that are held by the second sample/hold part 313 during a second horizontal period C that is the even numbered horizontal period EH.

The source driving chip 310 processes the data signals 18', 19', . . . 34' corresponding to the eighteenth to thirty fourth lines based on the second reference gamma voltages 250*a* that are held by the second sample/hold part 313 during a nineteenth horizontal period D. The first reference gamma voltages 250*a* correspond to the analog typed driving voltage AVDD of about 7.8V. The second reference gamma voltages 250*a* correspond to the analog typed driving voltage AVDD of about 8V.

The timing controlling part 210 drives the display device so that the even numbered frame 2N FRAME shown in FIG. 10B is displayed on the display device.

Referring to FIG. 10B, the bright gray scale (or the dark gray scale) is displayed on the display device corresponding to the first to seventeenth lines that are processed by the first reference gamma voltages. The dark gray scale (or the bright gray scale) is displayed on the display device corresponding to the eighteenth to thirty fourth lines that are processed by the second reference gamma voltages.

Referring to FIGS. 10A and 10B, the stripe corresponding to the odd numbered frame 2N−1 FRAME has a substantially opposite shape to the stripe corresponding to the even numbered frame 2N FRAME. For example, the first to seventeenth lines of the odd numbered frame 2N−1 FRAME displays the dark gray scale, and the first to seventeenth lines of the even numbered frame 2N FRAME displays the bright gray scale.

Therefore, the stripes of the odd numbered frame 2N−1 FRAME compensate the stripes of the even numbered frame 2N FRAME that has the opposite gray scale to that of the odd numbered frame 2N−1 FRAME, thereby improving the image display quality.

In FIGS. 1 to 10B, the reference gamma voltages are refreshed in every 17H period that is an odd number. Other odd numbered periods would be within the scope of these embodiments.

Alternatively, when the reference gamma voltages are refreshed in every 16H period that is an even number, the horizontal stripe may be displayed on the display device by the driving voltage difference between the odd numbered horizontal period OH and the even numbered horizontal period EH in the 2×1 inversion period.

The data signal of the odd numbered frame may also be delayed with respect to the data signal of the even numbered frame by the 1H period to decrease the horizontal stripe. In such a case, block S130 in FIG. 8 may read "EVEN NUMBERED FRAME?" If the frame is determined to be an even numbered frame, then the data signal would be processed as normal in block S140. However, if the frame is not determined to be an even numbered frame, then the period is delayed by 1H in block S135 and the data signal is then processed in block S140 in the 1H delay driving method. Alternatively, the reference gamma voltages may be refreshed in various periods.

Figure 11A:
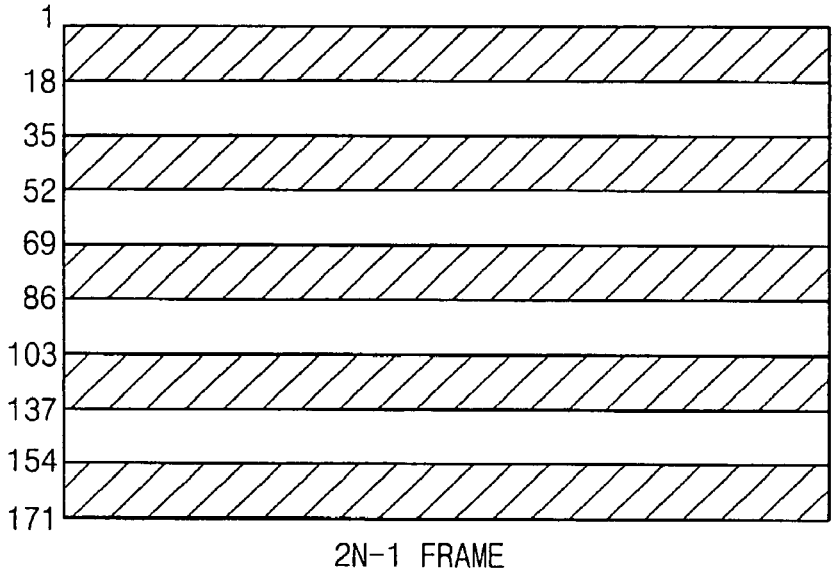
FIGS. 11A and 11B are plan views showing adjacent frames displayed by another method for driving a display device.
Figure 11B:
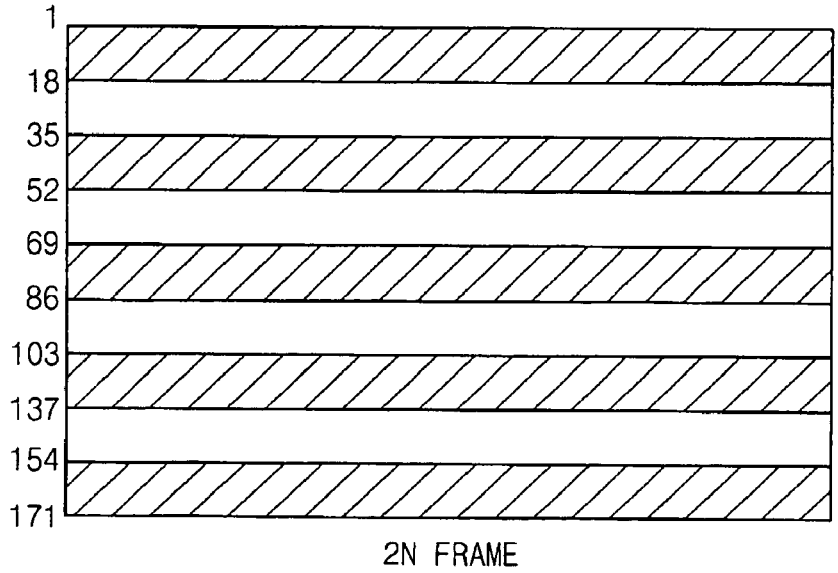

FIGS. 11A and 11B are plan views showing adjacent frames displayed by another method for driving a display device. Referring to FIGS. 11A and 11B, an odd numbered frame 2N−1 FRAME is not delayed with respect to an even numbered frame 2N FRAME.

When the odd numbered frame 2N−1 FRAME is not delayed with respect to the even numbered frame 2N FRAME, the stripe of the odd numbered frame 2N−1 FRAME is substantially the same as the stripe of the even numbered frame 2N FRAME. The bright horizontal stripe of the odd numbered frame 2N−1 FRAME corresponds to the bright horizontal stripe of the even numbered frame 2N FRAME, and the dark horizontal stripe of the odd numbered frame 2N−1 FRAME corresponds to the dark horizontal stripe of the even numbered frame 2N FRAME so that the horizontal stripes may not be compensated, thereby deteriorating the image display quality.

However, in FIGS. 2 to 10B, the horizontal stripes of the odd and even numbered frames are mixed to be compensated, thereby improving the image display quality of the display device.

According to the present invention, in the display device of the 2×1 inversion method and the serial gamma voltage method, the horizontal stripe is decreased to improve the image display quality of the display device.

In particular, the odd numbered frame (or the even numbered frame) is delayed by the 1H period, and the even numbered frame is displayed so that the horizontal stripe of the odd numbered frame is compensated by the horizontal stripe of the even numbered frame, thereby improving the image display quality.

This invention has been described with reference to the exemplary embodiments. It is evident, however, that many alternative modifications and variations will be apparent to those having skill in the art in light of the foregoing description. Accordingly, the present invention embraces all such alternative modifications and variations as fall within the spirit and scope of the appended claims.

What is claimed is:

1. A display device comprising:

a display panel including a plurality of pixel parts displaying an image;

a reference gamma processing part outputting a reference gamma voltage in every period;

a source driving part converting a data signal into a data voltage of an analog type based on the reference gamma voltage during the period; and a timing controlling part delaying the data signal of at least one frame and the reference gamma voltage based on the at least one frame corresponding to the data signal delayed by the timing controlling part to apply a delayed data signal and a delayed reference gamma voltage to the source driving part, wherein the timing controlling part delays the data signal and the reference gamma voltage by a predetermined interval when the frame is one of an, even numbered frame and an odd numbered frame, and the timing controlling part outputs the data signal and the reference gamma voltage without delay when the frame is the remaining frame to the source driving part.

2. The display device of claim 1, wherein the at least one frame is an even numbered frame.

3. The display device of claim 1, wherein the at least one frame is an odd numbered frame.

4. The display device of claim 1, wherein the timing controlling part controls the source driving part so that the source driving part inverts a polarity of the data voltage in every 2H period, with H being a horizontal period.

5. The display device of claim 1, wherein the timing controlling part delays the data signal corresponding to the at least one frame and the reference gamma voltage by 1H period.

6. The display device of claim 1, wherein the timing controlling part delays the data signal corresponding to the at least one frame and the reference gamma voltage based on a vertical synchronizing signal of the at least one frame of the data signal.

7. The display device of claim 1, wherein the reference gamma processing part comprises:

a gamma storing part storing reference gamma data; and a digital-analog converting part converting reference gamma data into reference gamma voltage of an analog type to apply analog typed reference gamma voltage to the source driving part.

8. The display device of claim 1, wherein the source driving part comprises:

a first sample/hold part that sampling the data signal applied to the source driving part to hold sampled data signal;

a second sample/hold part sampling the reference gamma voltage to hold sampled reference gamma voltage; and a digital-analog converting part converting held data signal into the data voltage of an analog type based on held reference gamma voltage.

9. The display device of claim 1, wherein a stripe displayed on the display panel in the at least one frame has a first gray scale and is compensated by a stripe, having a second gray scale opposite to the first gray scale, in a frame subsequent to the at least one frame.

10. A method of driving a display device including a display panel having a plurality of pixel parts displaying an image, the method comprising:

determining at least one frame corresponding to a data signal;

delaying the data signal of the at least one frame and a reference gamma voltage based on the at least one frame corresponding to the data signal to output a delayed data signal of the at least one frame and a delayed reference gamma voltage;

converting the data signal into a data voltage of an analog type based on the reference gamma voltage; and inverting a polarity of the data voltage in every 2H period to apply inverted data voltage to the pixel parts, wherein H is a horizontal period, wherein the data signal and the reference gamma voltage are delayed by a predetermined interval when the frame is one of an even numbered frame and an odd numbered frame, and the data signal and the reference gamma voltage are outputted without delay when the frame is the remaining frame.

11. The method of claim 10, wherein determining at least one frame includes determining the at least one frame to be an even numbered frame.

12. The method of claim 10, wherein determining at least one frame includes determining the at least one frame to be an odd numbered frame.

13. The method of claim 10, wherein delaying the data signal corresponding to the at least one frame and the reference gamma voltage includes delaying the data signal corresponding to the at least one frame and the reference gamma voltage by 1H period.

14. The method of claim 10, wherein determining at least one frame includes determining the at least one frame by a vertical synchronizing signal.

15. The method of claim 10, further comprising repetitively outputting the reference gamma voltage in a constant interval.

16. The method of claim 15, wherein converting the data signal into a data voltage based on the reference gamma voltage includes:

holding the reference gamma voltage; and converting the data signal into the data voltage based on held reference gamma voltage.

17. A display device driving apparatus comprising:

a reference gamma processing part outputting a reference gamma voltage in every period;

a source driving part converting a data signal into a data voltage of an analog type based on the reference gamma voltage during the period; and a timing controlling part delaying the data signal of at least one frame and the reference gamma voltage based on the at least one frame corresponding to the data signal to apply a delayed data signal and a delayed reference gamma voltage to the source driving part, wherein the timing controlling part delays the data signal and the reference gamma voltage by a predetermined interval when the frame is one of an even numbered frame and an odd numbered frame, and the timing controlling part outputs the data signal and the reference gamma voltage without delay when the frame is the remaining frame to the source driving part.

18. The driving apparatus of claim 17, wherein the at least one frame is an even numbered frame.

19. The driving apparatus of claim 17, wherein the at least one frame is an odd numbered frame.

20. The driving apparatus of claim 17, wherein the timing controlling part controls the source driving part so that the source driving part inverts a polarity of the data voltage in every 2H period, with H being a horizontal period.

21. The driving apparatus of claim 17, wherein the timing controlling part delays the data signal corresponding to the at least one frame and the reference gamma voltage by 1H period.

* * * * *